US010012416B2

(12) United States Patent
Kim

(10) Patent No.: US 10,012,416 B2
(45) Date of Patent: Jul. 3, 2018

(54) SPOT COOLING DEVICE

(71) Applicant: SEYANG MECHATRONICS. CO., LTD., Siheung-si (KR)

(72) Inventor: Byung Jun Kim, Siheung-si (KR)

(73) Assignee: SEYANG MECHATRONICS. CO., LTD., Siheung-si (KR)

( * ) Notice: Subject to any disclaimer, the term of this patent is extended or adjusted under 35 U.S.C. 154(b) by 0 days.

(21) Appl. No.: 15/113,065

(22) PCT Filed: Aug. 27, 2015

(86) PCT No.: PCT/KR2015/008983
§ 371 (c)(1),
(2) Date: Jul. 21, 2016

(87) PCT Pub. No.: WO2016/076518
PCT Pub. Date: May 19, 2016

(65) Prior Publication Data

US 2017/0261236 A1 Sep. 14, 2017

(30) Foreign Application Priority Data

Nov. 12, 2014 (KR) ..... 10-2014-0157090

(51) Int. Cl.
*F25B 9/02* (2006.01)
*F25B 9/04* (2006.01)
*F25B 9/00* (2006.01)

(52) U.S. Cl.
CPC ..... *F25B 9/04* (2013.01); *F25B 9/004* (2013.01); *F25B 2400/23* (2013.01)

(58) Field of Classification Search
CPC .... F25B 9/02; F25B 9/04; F25B 9/004; F25B 2400/23; F25J 2205/10
USPC ..... 62/401, 5
See application file for complete search history.

(56) References Cited

U.S. PATENT DOCUMENTS 6,990,817 B1 * 1/2006 Bhatia ..... F25B 9/04 62/259.2
7,263,836 B2 * 9/2007 Gunawardana ..... E21B 47/011 62/5
7,751,188 B1 * 7/2010 French ..... H05K 7/20736 165/104.33

FOREIGN PATENT DOCUMENTS

KR 100880276 2/2009
KR 100901741 6/2009
KR 20110132829 12/2011
KR 101211482 12/2012
(Continued)

OTHER PUBLICATIONS

International Search Report—PCT/KR2015/008983 dated Nov. 30, 2015.

(Continued)

*Primary Examiner* — Joseph Trpisovsky
(74) *Attorney, Agent, or Firm* — Cantor Colburn LLP

(57) ABSTRACT

A spot cooling device which separates injected compressed air into hot air and cold air to discharge the hot air and eject the cold air to a space or subject includes: a main body including: an injection port through which compressed air is injected; a cold air nozzle through which cold air separated from the injected compressed air is ejected; and a passage part connected to the cold air nozzle and the injection port; and a temperature control unit installed through the passage part so as to control an opening degree of the passage part according to temperature change.

4 Claims, 4 Drawing Sheets

(56) References Cited

FOREIGN PATENT DOCUMENTS

| | | |
|---|---|---|
| KR | 101297382 | 8/2013 |
| KR | 20130127363 | 11/2013 |
| KR | 101385148 | 4/2014 |

OTHER PUBLICATIONS

Internet: http://blog.naver.com/seyangmecha/50160707382, Vortex CNC Mechanical Thermostats [Online], Seyang Mechatronics Blog, 2013.

* cited by examiner

SPOT COOLING DEVICE

TECHNICAL FIELD

The present disclosure relates to a spot cooling device, and more particularly, to a low-vibration and low-noise spot cooling device which separates injected compressed air into hot air and cold air so as to discharge the hot air and eject the cold air to a space or subject which is required to be cooled, is utilized for an environment in which electricity is not available (explosion-proof area and chemical factory in which electricity is dangerous to use) or an environment required to minimize the use of electricity for low-power operations (business establishments which expect reduction and saving on the compressed air and an energy saving effect), and includes a temperature control unit which immediately senses internal heat of a control panel (cabinet) in a no-power state, ejects cold air into the control panel such that the control panel can be operated while maintaining the optimal temperature and humidity, and automatically blocks the supply of compressed air when a proper temperature is maintained.

BACKGROUND ART

In general, a spot cooling device has a low price, exhibits high reliability, and does not need maintenance. Thus, the spot cooling device is used as a solution to spot cooling operations in various industrial sites, and utilizes general compressed air (compressor) used in the industrial sites as a driving energy source.

The spot cooling device generates a cold air flow and a hot air flow at the same time, without a mechanical driving unit.

The spot cooling device is used in an operation for cooling electronic control and communication equipment, an operation for cooling a control box of industrial equipment (maintaining temperature), an operation for cooling a PLC motor controller (maintaining temperature), a spot cooling operation of a machine work process (replacing cutting oil), an operation for cooling a CCTV camera installed in a high-temperature environment, an operation for solidifying molten metal, an operation for cooling a soldered or welded portion, an operation for cooling a high-capacity switching element, an operation for cooling a high-temperature mechanical sealing and a process for manufacturing performance test equipment for creating a severe low-temperature environment.

Such a spot cooling device has been disclosed in Korean Patent No. 10-0880276 registered on Jan. 23, 2009 and entitled "Vortex tube" (related art 1) and Korean Patent No. 10-0901741 registered on Jun. 2, 2009 and entitled "Air dryer using vortex tube" (related art 2).

In the spot cooling devices disclosed in the related arts 1 and 2, however, compressed air passing through a rotation induction member of a rotating chamber is rotated and introduced into the entrance of a separation chamber, and then rotated and moved to the exit of the separation chamber. Therefore, the spot cooling devices exhibit low efficiency in separating the compressed air into cold air and hot air.

The spot cooling device is utilized as a device which continuously supplies cold air to a heating portion (spot), in order to constantly maintain the temperature of the environment where the spot cooling device is installed.

Such a cooling device with an automatic temperature control function has been disclosed in Korean Patent No. 10-1211482 registered on Dec. 6, 2012 and entitled "MGO cooling system" (related art 3) and Korean Patent No. 10-1297382 registered on Aug. 9, 2013 and entitled "Automatically controlled cooling system" (related art 4).

However, since automatic temperature control units disclosed in the related arts 3 and 4 require electricity and drive a shutoff valve through an electrical device, a driving voltage must be applied to the automatic temperature control units.

Therefore, the cooling systems are difficult to use in the environment where electricity cannot be used or the use of electricity must be minimized for low-power operations.

DISCLOSURE

Technical Problem

Various embodiments are directed to a spot cooling device which separates injected compressed air into hot air and cold air such so as to discharge the hot air and eject the cold air to a space or subject which generates heat, and thus constantly maintains the temperature of the installation space and subject.

Also, various embodiments are directed to a spot cooling device which includes an analog automatic temperature control unit requiring no electricity, and can be utilized for an environment in which electricity is not available (explosion-proof area and chemical factory in which electricity is dangerous to use) or an environment required to minimize the use of electricity for low-power operations (business establishments which expect reduction and saving on compressed air and an energy saving effect).

Further, various embodiments are directed to a spot cooling device including an opening/closing member which has a contact end and an inclined part, can minimize friction to improve an advance/retreat operation characteristic, and sensitively respond to a small force of an expansion member.

Further, various embodiments are directed to a spot cooling device which includes a vibration proof member installed in a housing so as to operate with low vibration and low noise.

Technical Solution

According to an aspect of the present invention, a spot cooling device may include: a main body including: an injection port through which compressed air is injected; a cold air nozzle through which cold air separated from the injected compressed air is ejected; and a passage part connected to the cold air nozzle and the injection port; and a temperature control unit installed through the passage part so as to control an opening degree of the passage part according to temperature change.

The temperature control unit may include: a control screw member coupled to a female screw part formed at the front of the main body; an expansion member inserted into a space formed in a male screw part of the control screw member and expanded and contracted according to temperature; a pressurizing member inserted into the space of the control screw part and advanced and retreated in the space by the expansion member; and an opening/closing member having one end contacted with an end of the pressurizing member; and a return member elastically supporting the opening/closing member.

The opening/closing member may include: a contact end contacted with the end of the pressurizing member; an inclined part connected to the contact end and having a diameter which increases toward the rear; and a side surface part connected to the inclined part and disposed at the injection port so as to seal the injection port.

The spot cooling device may further include: a cold/hot air separation chamber connected to the passage part and disposed at the rear of the main body, and a vibration proof member covering the outside of the cold/hot air separation chamber.

Advantageous Effects

The spot cooling device according to the present invention can separate injected compressed air into hot air and cold air so as to discharge the hot air and eject the cold air to a space or subject which generates heat, and thus constantly maintain the surrounding temperature of the installation space or subject.

Furthermore, the spot cooling device includes the analog automatic temperature control unit requiring no electricity, and can be utilized for an environment in which electricity is not available (explosion-proof area and chemical factory in which electricity is dangerous to use) or an environment required to minimize the use of electricity for low-power operations (business establishments which expect reduction and saving on the compressed air and an energy saving effect).

Furthermore, the opening/closing member includes the contact end and the inclined part, can minimize friction to improve the advance/retreat operation characteristic, and sensitively respond to a small force of an expansion member.

Furthermore, the spot cooling device includes the vibration proof member installed in the housing so as to operate with low vibration and low noise, which makes it possible to satisfy users' satisfaction.

MODE FOR INVENTION

Figure 1:
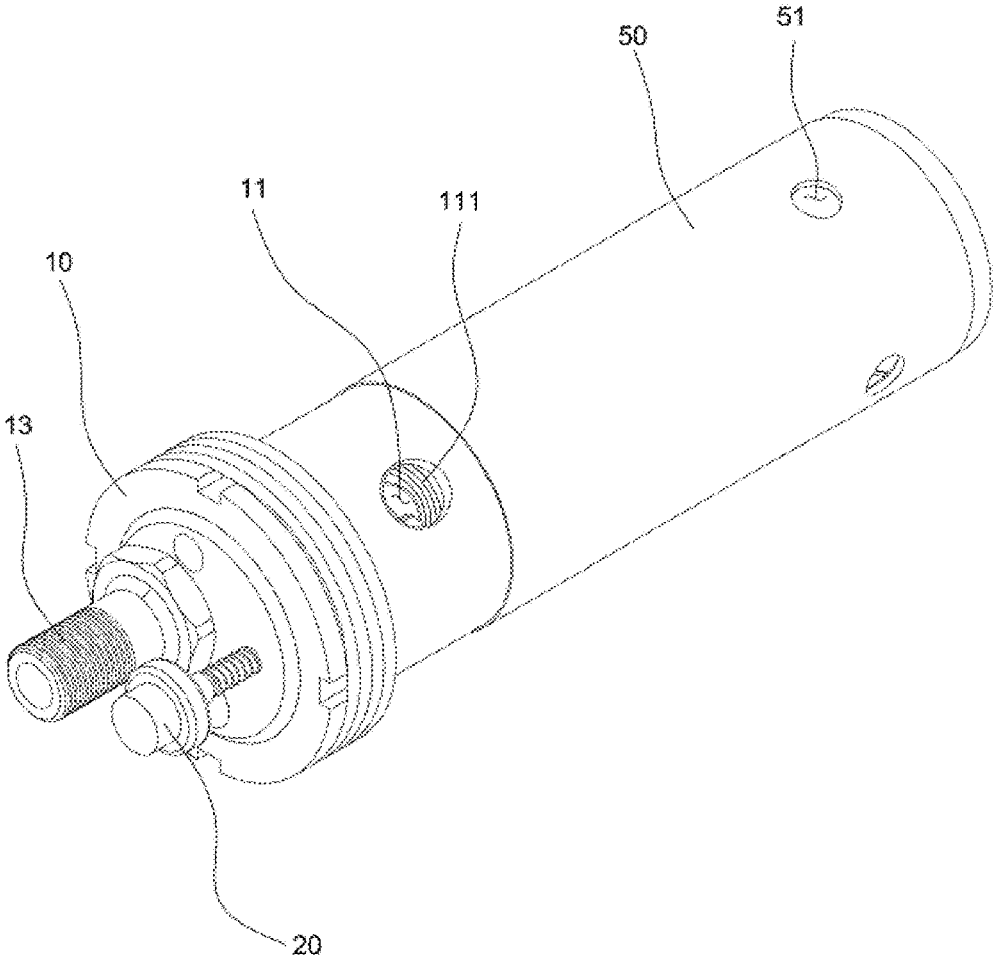
FIG. 1 is a perspective view of a spot cooling device according to an embodiment of the present invention.

Hereafter, exemplary embodiments of the present invention will be described in detail with reference to the accompanying drawings.

Since the present invention can have various modification and various forms, aspects or embodiments will be described in detail. However, the present invention is not limited to specific embodiments, and may include all of variations, equivalents, and substitutes within the scope of the present invention.

In the respective drawings, like reference numerals or particularly reference numerals having the same values in the tens place and the ones place or reference numerals having the same values in the tens place and the ones place and having the same alphabets represent members having the same or similar functions. Unless referred to the contrary, members indicated by the respective reference numerals in the drawings will be understood as members following the standards.

Furthermore, for convenience of understanding, the sizes or thicknesses of elements in the drawings may be exaggerated (increased or decreased) or simplified. However, the scope of the present invention is not limited thereto.

The terms used in this specification are used to describe specific aspects or embodiments, and not intended to limit the present invention. The terms of a singular form may include plural forms unless referred to the contrary. In this application, the term "include" or "have" specifies a feature, number, step, operation, element, part or combination thereof which is described in the specification, but does not exclude one or more other features, numbers, steps, operations, elements, parts or combinations thereof.

All terms including technical or scientific terms in this specification have the same meanings as the terms which are generally understood by those skilled in the art to which the present invention pertains, as long as they are differently defined. The terms defined in a generally used dictionary should be analyzed to have meanings which coincide with contextual meanings in the related art. As long as the terms are not clearly defined in this specification, the terms may not be analyzed as ideal or excessively formal meanings.

In the present specification, the terms such as "first" and "second" are used only to distinguish between different elements, regardless of the order that the elements were manufactured. In the detailed descriptions and claims of the present invention, the elements may have different names.

Before the present invention is described, approximate directions may be specified as follows.

In a state of FIG. 1, the left side in which a main body 10 is positioned is set to the front of the spot cooling device, and the right side in which a housing 50 is positioned is set to the rear of the spot cooling device. The following descriptions will be based on the directions.

Furthermore, inside and outside may indicate inner and outer directions and spaces from a common-sense point of view, and claims will also follow the standards unless otherwise noted.

As illustrated in FIG. 1, the spot cooling device A according to an embodiment of the present invention includes a main body 10 and a temperature control unit 20.

The spot cooling device further includes a housing 50 coupled to the rear of the main body 10.

The housing 50 has a hot air outlet 51 which is formed on the outer surface thereof so as to discharge hot air.

The spot cooling device may further include a frame and O-ring which are installed along the circumference of the main body 10.

The respective elements will be described in more detail with reference to the accompanying drawings.

Figure 2:
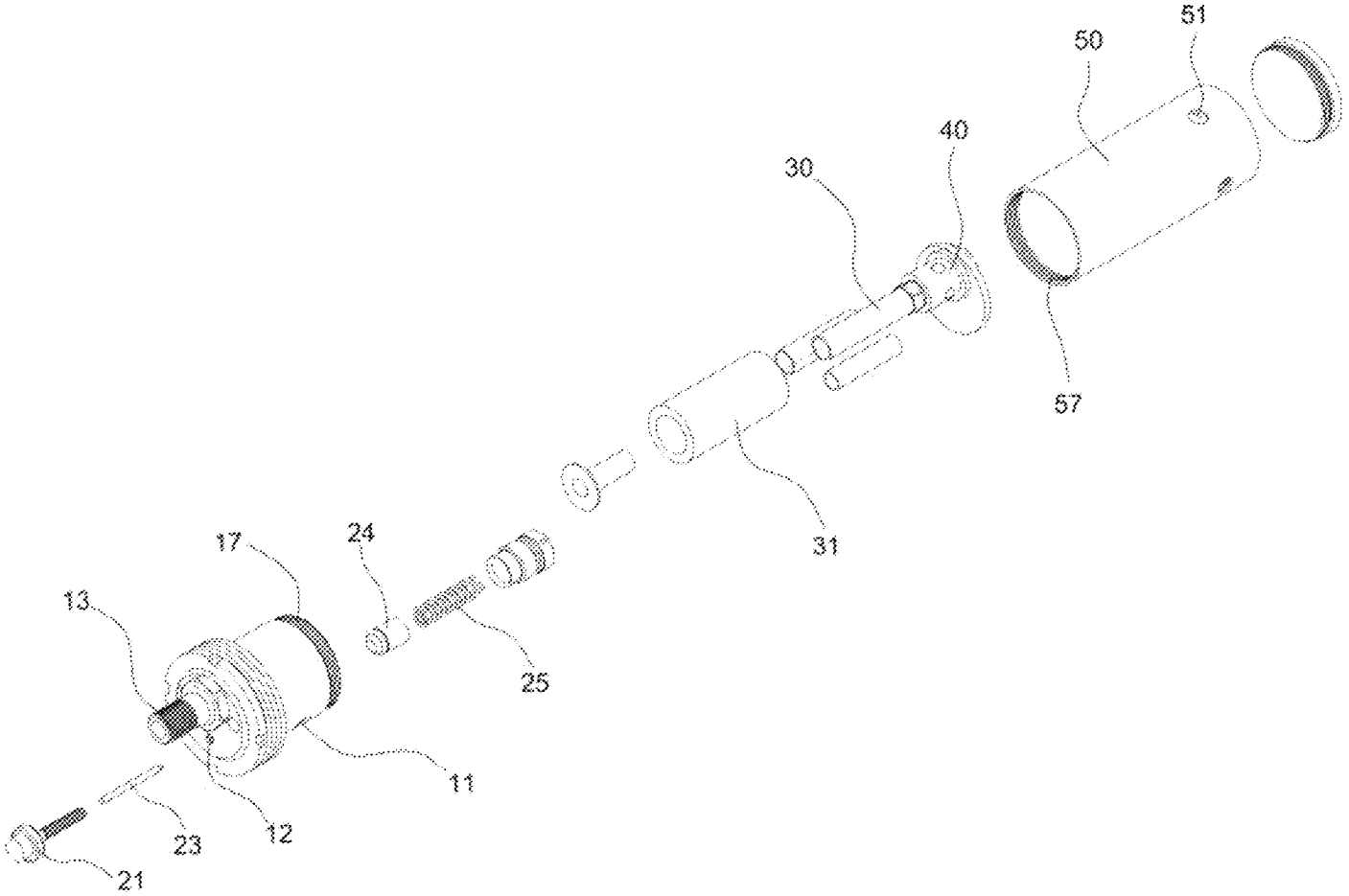
FIG. 2 is an exploded perspective view of the spot cooling device according to the embodiment of the present invention.

As illustrated in FIGS. 1 and 2, the main body 10 according to the embodiment of the present invention includes an injection port 11 through which compressed air is injected.

The injection port 11 is a path connected to a compressor to inject compressed air, and has a screw thread 111 formed on the inner circumference thereof. The injection port 11 may be consistently coupled to the compressor through the screw thread 111.

As illustrated in FIGS. 1 and 2, the main body 10 according to the embodiment of the present invention further includes a cold air nozzle 13 through which cold air separated from the injected compressed air is ejected.

Referring to FIG. 2, a cold/hot air separation chamber 30 is installed at the rear of the main body 10, and the compressed air injected through the injection port 11 is divided into cold air and hot air through the cold/hot air separation chamber 30.

The cold air of the compressed air is ejected through the cold air nozzle 13 of the main body 10, and the hot air is ejected through a hot air nozzle 40 installed at the rear of the cold/hot air separation chamber 30.

The cold air nozzle 13 may be directly connected to a space which is intended to be cooled by the spot cooling device A, such that the cold air is directly ejected to the space.

Figure 4:
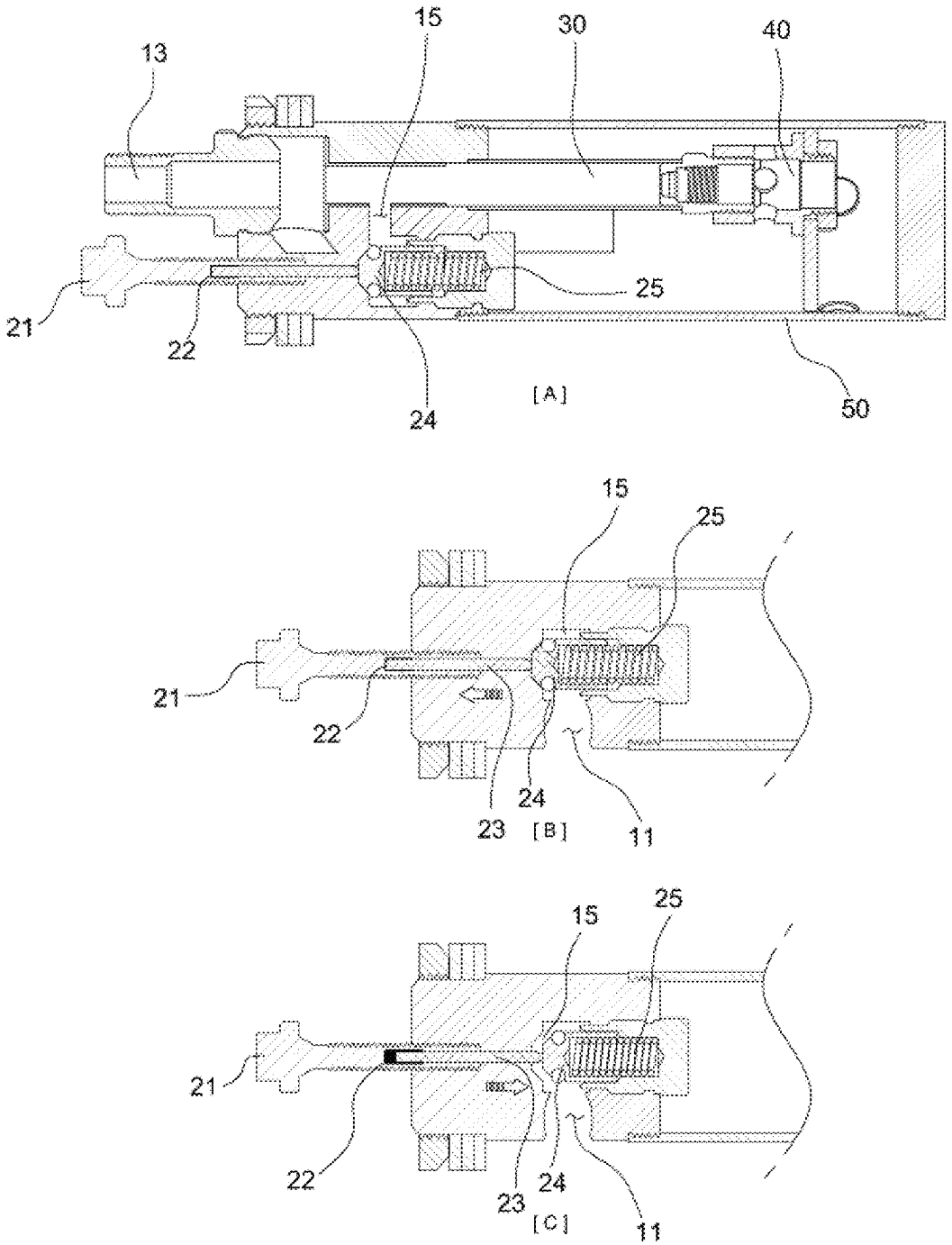
FIG. 4 is a diagram illustrating an opening/closing process of the spot cooling device according to the embodiment of the present invention.

As illustrated in FIG. 4, the main body 10 further includes a passage part 15 connected to the cold air nozzle 13 and the injection port 11.

[A] of FIG. 4 is a cross-sectional view when seen from the top, and [B] and [C] of FIG. 4 are cross-sectional views when seen from the side.

The passage part 15 corresponds to an internal space of the main body 10. As illustrated in FIG. 4, the cold air nozzle 13 is installed at the front of the passage part 15, and the injection port 11 is formed at the side of the passage part 15.

The passage part 15 is an element which constitutes the core of the present invention, with the temperature control unit 20 to be described below. The passage part 15 can be opened and closed to automatically control the temperature of a space which is intended to be cooled.

The temperature control unit 20 is an analog element which does not require an electrical device A.

Therefore, the spot cooling device can detect the temperature of the inside of a control panel (cabinet), which is intended to be cooled, immediately cool the control panel when the internal temperature of the control panel rises, and control the ejected compressed air (cold air), thereby obtaining an energy saving effect.

Thus, the spot cooling device can be more effectively utilized when an automatic temperature control device A using a general electrical control method is difficult to install, for example, when the electrical device A is difficult to install due to the characteristic of a space to be cooled or power consumption is intended to be minimized.

Next, the temperature control unit 20 which is installed through the passage part 15 and controls the opening degree of the passage part 15 according to temperature change will be described in more detail.

As described above, the temperature control unit 20 is a core element for accomplishing the core task of the present invention, that is, 'non-electrical automatic temperature control'.

As illustrated in FIGS. 2 and 4, the temperature control unit 20 includes a control screw member 21 which is coupled to a female screw part 12 formed at the front of the main body 10.

The control screw member 21 may set the initial displacement of a pressurizing member 23, and control the stroke length of the pressurizing member 23, thereby setting the maximum or minimum value of the opening degree of the injection port 11 for temperature control.

More specifically, the control screw member 21 may initially set a temperature range which is intended to be controlled, through the displacement of the control screw member 21 within the female screw part 12. The displacement of the control screw member 21 may indicate how much the control screw member 21 enters and comes out of the female screw part 12.

Figure 3:
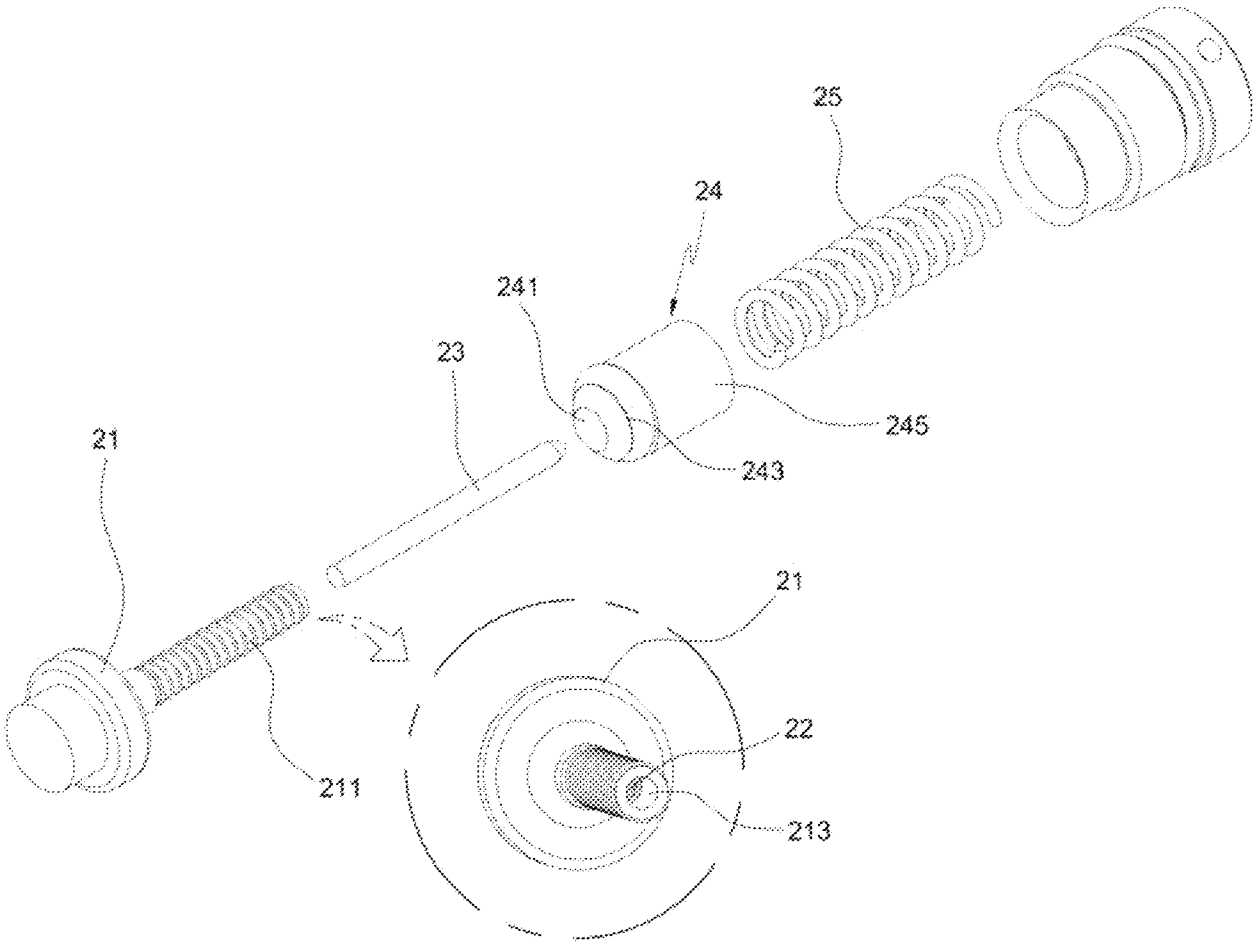
FIG. 3 is a detailed diagram of a temperature control unit according to the embodiment of the present invention.

As illustrated in FIGS. 2 to 4, the temperature control unit 20 further includes an expansion member 22 which is inserted into a space 213 formed in a male screw part 211 of the control screw member 21 and expanded or contracted according to the temperature.

The expansion member 22 which is formed of a material expanded by heat may have a solid or gel state. When the temperature rises in a state where the expansion member 22 is inserted into the space 213 of the male screw part 211 of the control screw member 21, the expansion member 22 is expanded to narrow the space 213 ([C] of FIG. 4). On the other hand, when the temperature falls, the expansion member 22 is contracted to widen the space 213 ([B] of FIG. 4). Then, the pressurizing member is advanced as much as the space.

As illustrated in FIGS. 2 to 4, the temperature control unit 20 further includes a pressurizing member 23 which is inserted into the space 213 of the control screw member 21 and advanced and retreated in the space 213 by the expansion member 22.

When the temperature of the installation environment rises, the expansion member 22 is expanded to narrow the space 213. Then, the pressurizing member 23 inserted into the space 213 is pushed and retreated by the expansion member 22 and partially comes out of the space 213 ([C] of FIG. 4).

When the temperature of the installation environment falls, the expansion member 22 is contracted to widen the space 213. Then, the pressurizing member 23 inserted into the space 213 is advanced as much as the expansion member 22 is contracted, and partially enters the space 213 ([B] of FIG. 4).

The temperature control unit 20 further includes an opening/closing member 24 having an end contacted with an end of the pressurizing member 23, and a return member 25 elastically supporting the opening/closing member 24.

While the pressurizing member 23 is advanced and retreated, the retreat of the pressurizing member 23 by the expansion of the expansion member 22 can be naturally performed, but the advance of the pressurizing member 23 by the contraction of the expansion member 22 cannot be naturally performed. Therefore, the advances of the pressurizing member 23 and the opening/closing member 24 need to be elastically supported at all times through the opening/closing member 24 contacted with the end of the pressurizing member 23 and the return member 25 elastically supporting the opening/closing member 24.

When the temperature of the installation environment rises to retreat the pressurizing member 23, the opening/closing member 24 is also pushed and retreated to open the injection port 11, thereby increasing the amount of injected compressed air.

When the temperature of the installation environment falls to advance the pressurizing member 23, the opening/closing member 24 is also advanced to close the injection port 11, thereby reducing the amount of injected compressed air.

Since the amount of cold air ejected through the cold air nozzle 13 is changed according to the amount of injected compressed air, the temperature of the installation environment (spot) can be automatically controlled.

Furthermore, as illustrated in FIGS. 2 and 4, the return member 25 is formed of a spring, and serves to elastically support the advances of the pressurizing member 23 and the opening/closing member 24 at all times.

Furthermore, as illustrated in FIGS. 2 and 4, a finishing member is installed at an end of the return member 25. The finishing member serves as a kind of cover for sealing the passage part 15 while preventing separation of the return member 25.

Hereafter, the opening/closing member 24 will be described in more detail with reference to the accompanying drawings.

As described above, the core task of the present invention is 'non-electrical automatic temperature control'.

The feature of the opening/closing member 24 for the core task of the present invention is one of important core features. The feature of the opening/closing member 24 will be described as follows.

As illustrated in FIG. 3, the opening/closing member 24 includes a contact end 241 contacted with the end of the pressurizing member 23, an inclined part 243 connected to the contact end 241 and having a diameter which gradually increases toward the rear, and a side surface part 245 connected to the inclined part 243 and disposed at the injection port 11 so as to seal the injection port 11.

Such a structure contributes to improving the operation characteristic of the opening/closing member 24.

When the opening/closing member 24 has a cylindrical shape or polyhedron structure, the advance/retreat operation of the opening/closing member 24 is disturbed by the friction of the side surface part 245.

For the non-electrical automatic temperature control which is the technical task of the present invention, however, the advances and retreats of all elements are determined through the expansion rate of the expansion member 22. Thus, the advance and retreat of the opening/closing member 24 need to be sensitively performed.

In order to minimize the friction of the side surface part 245 of the opening/closing member 24, the opening/closing member 24 includes the contact end 241, the inclined part 243 and the side surface part 245 which are integrated with each other. The inclined part 243 is connected to the contact end 241 and has a diameter which gradually increases toward the rear, and the side surface part 245 is formed at the rear of the inclined part 243.

Desirably, the side surface part 245 may have a shape corresponding to the shape of the injection port 11, in order to guarantee complete sealing of the injection port 11 in some cases.

Another core feature of the present invention is that the spot cooling device A is operated with low noise and low vibration.

As illustrated in FIG. 2, the spot cooling device A according to the embodiment of the present invention further includes a vibration proof member 31 surrounding the outside of the cold/hot air separation chamber 30.

First, as illustrated in FIG. 2, the cold/hot air separation chamber 30 is connected to the passage part 15, and disposed at the rear of the main body 10.

Thus, the injected compressed air is separated into cold air and hot air through the cold/hot air separation chamber 30, the cold air is ejected through the cold air nozzle 13 installed at the front of the cold/hot air separation chamber 30, and the hot air is ejected through the hot air nozzle 40 connected to the rear of the cold/hot air separation chamber 30 or the hot air outlet 51 formed in the housing 50. Therefore, only the cold air is ejected to the space which is intended to be cooled.

The vibration proof member 31 absorbs vibration and noise generated from the cold/hot air separation chamber 30 such that the vibration and noise are not discharged to the outside, thereby accomplishing 'low-vibration low-noise operation' which is another core feature of the present invention.

Hereafter, the process for separating compressed air into hot air and cold air in the spot cooling device A and the principle thereof will be briefly described.

The detailed descriptions of the process and principle can be checked through Korean Patent No. 10-1385148 published on Apr. 8, 2014 and entitled "High-efficiency spot cooling device", which is a previous application of the present applicant. Thus, the detailed descriptions are omitted herein.

The process for separating compressed air into hot air and cold air and the principle thereof are as follows. The compressed air introduced into the entrance of the cold/hot air separation chamber 30 is moved to the exit while rotating along the inner wall of the cold/hot air separation chamber 30, a part of the compressed air reaching the exit is ejected to the hot air nozzle 40 at the rear, and the other part of the compressed air which is not ejected flows backward to the entrance. The air backflow is cooled while losing heat, passed through the entrance of the cold/hot air separation chamber 30, and ejected through the cold air nozzle 13 installed in the main body 10.

The reason that the air backflow (that is, cold air) loses heat is follows. The air rotating and flowing along the inner wall of the cold/hot air separation chamber 30 flows in a high temperature state toward the exit of the cold/hot air separation chamber 30, a part of the air is discharged through the hot air nozzle 40, and the other part of the air is cooled while rotating in the same direction at the exit-side center of the cold/hot air separation chamber 30, and discharged toward the entrance of the cold/hot air separation chamber 30. At this time, the airs flowing in the opposite directions at the edge and center of the cold/hot air separation chamber 30, that is, the hot air and cold air are rotated in the same direction and at the same speed.

According to the law of conservation of angular momentum (rotary momentum) among the dynamics laws, the air rotating along the outside with a large radius of rotation, that is, the hot air needs to be introduced to the inside with a small radius of rotation and circulated while the rotation speed increases.

However, the angular velocity of the air (cold air) circulating along the inside in the cold/hot air separation chamber 30 is not increased but the same as the air is circulated along the outside. This is because the air lost the angular momentum.

When the inner air lost the angular momentum, it indicates that the inner air lost energy and thus the temperature fell. The energy that the inner air lost is transmitted to the air rotating along the outside, and heats the air rotating along the outside.

As illustrated in FIGS. 1 and 2, the spot cooling device A further includes the housing 50 which surrounds the rear portion of the main body 10 including the cold/hot air separation chamber 30.

Furthermore, a first coupling part 17 for connection to the housing 50 is formed at the rear of the main body 10, and a second coupling part 57 to be coupled to the first coupling part 17 is formed at the front end of the housing 50.

FIG. 2 illustrates that the first and second coupling parts 17 and 57 are screwed to each other.

Furthermore, the hot air outlet 51 for discharging a remaining amount of hot air discharged through the hot air nozzle 40 is formed in the shape of a through-hole in the housing 50.

The detailed descriptions of the publicly known technology related to the materials of the respective elements in the detailed descriptions of the present invention or particularly the materials of the vibration proof member 31 and the expansion member 22 are omitted herein. However, the technology can be easily understood and embodied by those skilled in the art.

While various embodiments have been described above, it will be understood to those skilled in the art that the embodiments described are by way of example only. Accordingly, the disclosure described herein should not be limited based on the described embodiments.

The invention claimed is:

1. A spot cooling device comprising:

a main body comprising:

an injection port through which compressed air is injected;

a cold air nozzle through which cold air separated from the injected compressed air is ejected; and a passage part connected to the cold air nozzle and the injection port; and a temperature control unit installed through the passage part so as to control an opening degree of the passage part according to temperature change, wherein the temperature control unit comprises:

a control screw member coupled to a female screw part formed at the front of the main body;

an expansion member inserted into a space formed in a male screw part of the control screw member and expanded and contracted according to temperature;

a pressurizing member inserted into the space of the control screw part and advanced and retreated in the space by the expansion member; and an opening/closing member having one end contacted with an end of the pressurizing member; and a return member elastically supporting the opening/closing member.

2. The spot cooling device of claim 1, further comprising a housing covering the rear portion of the main body, wherein the main body has a first coupling part formed at the rear end thereof, and the housing has a second coupling part formed at the front end thereof and coupled to the first coupling part.

3. The spot cooling device of claim 1, wherein the opening/closing member comprises:

a contact end contacted with the end of the pressurizing member;

an inclined part connected to the contact end and having a diameter which increases toward the rear; and a side surface part connected to the inclined part and disposed at the injection port so as to seal the injection port.

4. The spot cooling device of claim 3, further comprising:

a cold/hot air separation chamber connected to the passage part and disposed at the rear of the main body, and a vibration proof member covering the outside of the cold/hot air separation chamber.

* * * * *